US009979142B2

(12) United States Patent
Gunther

(10) Patent No.: US 9,979,142 B2
(45) Date of Patent: May 22, 2018

(54) FILTER ARRANGEMENT FOR HIGH-VOLTAGE CONNECTOR AND HIGH-VOLTAGE CONNECTOR

(71) Applicant: TE Connectivity Germany GmbH, Bensheim (DE)

(72) Inventor: Chritz Gunther, Birkenau (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days. days.

(21) Appl. No.: 15/374,551

(22) Filed: Dec. 9, 2016

(65) Prior Publication Data

US 2017/0170610 A1 Jun. 15, 2017

(30) Foreign Application Priority Data

Dec. 10, 2015 (DE) ..... 10 2015 224 872

(51) Int. Cl.
*H01R 13/719* (2011.01)
*H01R 13/7193* (2011.01)
*H01R 27/02* (2006.01)
*H01R 13/66* (2006.01)

(52) U.S. Cl.
CPC ..... *H01R 13/7193* (2013.01); *H01R 13/665* (2013.01); *H01R 27/02* (2013.01)

(58) Field of Classification Search
CPC .. H01R 13/7193; H01R 27/02; H01R 13/665; H01R 13/719
USPC ..... 439/620.1
See application file for complete search history.

(56) References Cited

U.S. PATENT DOCUMENTS 5,119,059 A * 6/1992 Covi ..... H01F 27/38 323/250
9,722,565 B2 8/2017 Beck
2013/0224050 A1* 8/2013 Nakagami ..... F01C 21/10 417/410.1
2015/0372655 A1* 12/2015 Beck ..... H03H 1/0007 333/185

FOREIGN PATENT DOCUMENTS

DE 102008054675 A1 6/2010
DE 102013101323 A1 8/2014
JP 2012221895 A 11/2012

OTHER PUBLICATIONS

Abstract of JP2012221895, dated Nov. 12, 2012, 1 page.
(Continued)

*Primary Examiner* — Harshad C Patel
(74) *Attorney, Agent, or Firm* — Barley Snyder

(57) ABSTRACT

A filter assembly for a high-voltage connector is disclosed. The filter assembly has a first and a second bus bar, a filter circuit disposed on a circuit carrier, a ring core, and a filter housing. Each bus bar has a first terminal section, a second terminal section, and a connecting section between the first terminal section and the second terminal section. The filter circuit, the ring core, and at least a part of the first and second bus bars are disposed in the filter housing. The first and second bus bars extend substantially parallel to each other and through the ring core. The circuit carrier is disposed in a region of the filter housing in which the connecting section of each of the first and second bus bars is accommodated.

19 Claims, 5 Drawing Sheets

(56) References Cited

OTHER PUBLICATIONS

Abstract of DE102008054675, dated Jun. 24, 2010, 1 page.
Machine translation of JP2012221895, dated Nov. 12, 2012, 15 pages.
Translation of German Office Action dated Jun. 17, 2016, 5 pages.
Abstract of DE102013101323, dated Aug. 14, 2014, 2 pages.

* cited by examiner

FILTER ARRANGEMENT FOR HIGH-VOLTAGE CONNECTOR AND HIGH-VOLTAGE CONNECTOR

CROSS-REFERENCE TO RELATED APPLICATION

This application claims the benefit of the filing date under 35 U.S.C. § 119(a)-(d) of German Patent Application No. 102015224872.0, filed on Dec. 10, 2015.

FIELD OF THE INVENTION

The present invention relates to a filter assembly, and more particularly, to a filter assembly for a high-voltage connector.

BACKGROUND

Electromagnetic compatibility (EMC) is increasingly becoming a key in the development of electrical motor vehicle propulsion. Since the power requirements of an electrical propulsion chain cannot be fulfilled by conventional low-voltage vehicle electric systems (LV) having a supply voltage of 12 VDC, a traction vehicle electric system is introduced, the voltage level of which is typically in the range of 120 to 1000 VDC. This high-voltage (HV) vehicle electric system connects the energy store, usually placed underneath the luggage space in the rear of the vehicle, to the power converter and a synchronous machine in the engine compartment. Semiconductor components in the pulse inverter switch quickly in order to minimize thermal losses, and consequently, interference pulses with high amplitudes are created which contain high-frequency (HF) spectral components. These can disrupt adjacent electronic systems. The increasing number of sensitive radio services, such as VHF radio, GPS navigation, mobile telephony or driver assistance systems, exacerbates the problem. Systems outside of the vehicle must also not be disrupted; this is regulated in international standards such as CISPR 25 or EU Guideline ECE-R10.

In order to improve the EMC of the electrical propulsion, it is known to design the HV vehicle electrical system to be completely shielded. In this case, individually shielded coaxial cables are used which behave like waveguides in the HF range. These cables perform an impedance transformation of a line termination. Mismatching at the cable ends can lead to reflected disturbance variables and resonance magnifications due to standing waves on the line.

To connect the inverter to the battery, a suitably long shielded cable is required which can, however, endanger the safeguarding of the EMC. On the one hand, high shield currents can occur which, if they are in the high-frequency range, contribute to high emissions and voltage peaks which can even lead to damaging of the inverter or battery. Furthermore, disruptions can be coupled into the vehicle's low-voltage system. The impedance of the electrical and mechanical connection of the cable shield to the shielding of the battery or inverter must be extremely low in order to ensure sufficient shielding. Especially in vehicles, there arise, through vibration or shock, mechanical forces which weaken the shield connection and thus allow the impedance to grow over the long term. Ageing processes, from oxidation or corrosion, can also affect impedance.

The provision of EMC filters between the battery and the inverter is known. Known EMC filters are typically two-wire HV direct current filters which filter out the HF portions in the direct current output, thus reducing the disturbance emissions linked to the line. Furthermore, voltage peaks occur which are elevated through line inductances. In order to prevent a leakage current which results from this, it is known to employ ferrite ring cores, through which the lines are guided.

Such a known filter assembly having several ferrite ring cores is described in DE 10 2013 101 323 A1. The filter comprises a housing body, a first and at least one second bus bar which respectively have a first end section and a second end section, between which there is arranged a middle section. The end sections of the at least two bus bars respectively have terminals for linking electrical conductors to the filter. The first and second end sections and the middle section of the first bus bar are arranged in a first plane and the first and second end sections and the middle section of the at least one second bus bar are arranged in a second plane which is different from the first plane. As a result, the known filter can be connected to the electrical conductors in one mounting direction.

The provision of EMC filters and ring cores at the terminal panels of the battery, however, take up valuable installation space in the motor vehicle. Furthermore, costly connection techniques are required, which make installation more expensive and increase subsequent maintenance costs.

SUMMARY

An object of the invention, among others, is to provide a filter assembly which can be produced in a space-saving, reliable, and cost-effective manner. The disclosed filter assembly has a first and a second bus bar, a filter circuit disposed on a circuit carrier, a ring core, and a filter housing. Each bus bar has a first terminal section, a second terminal section, and a connecting section between the first terminal section and the second terminal section. The filter circuit, the ring core, and at least a part of the first and second bus bars are disposed in the filter housing. The first and second bus bars extend substantially parallel to each other and through the ring core. The circuit carrier is disposed in a region of the filter housing in which the connecting section of each of the first and second bus bars is accommodated.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
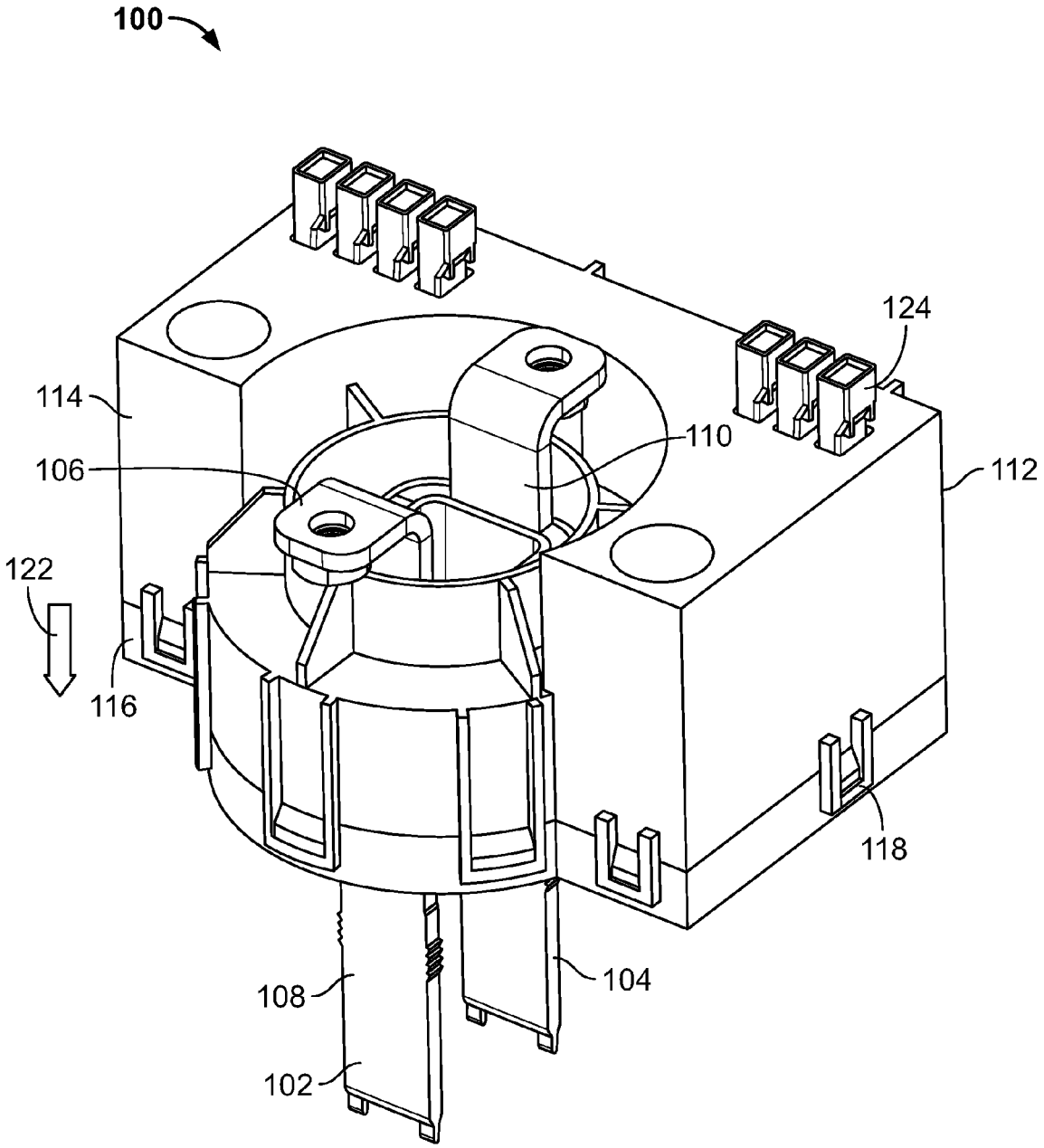
FIG. 1 is a perspective view of a filter assembly according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

Figure 2:
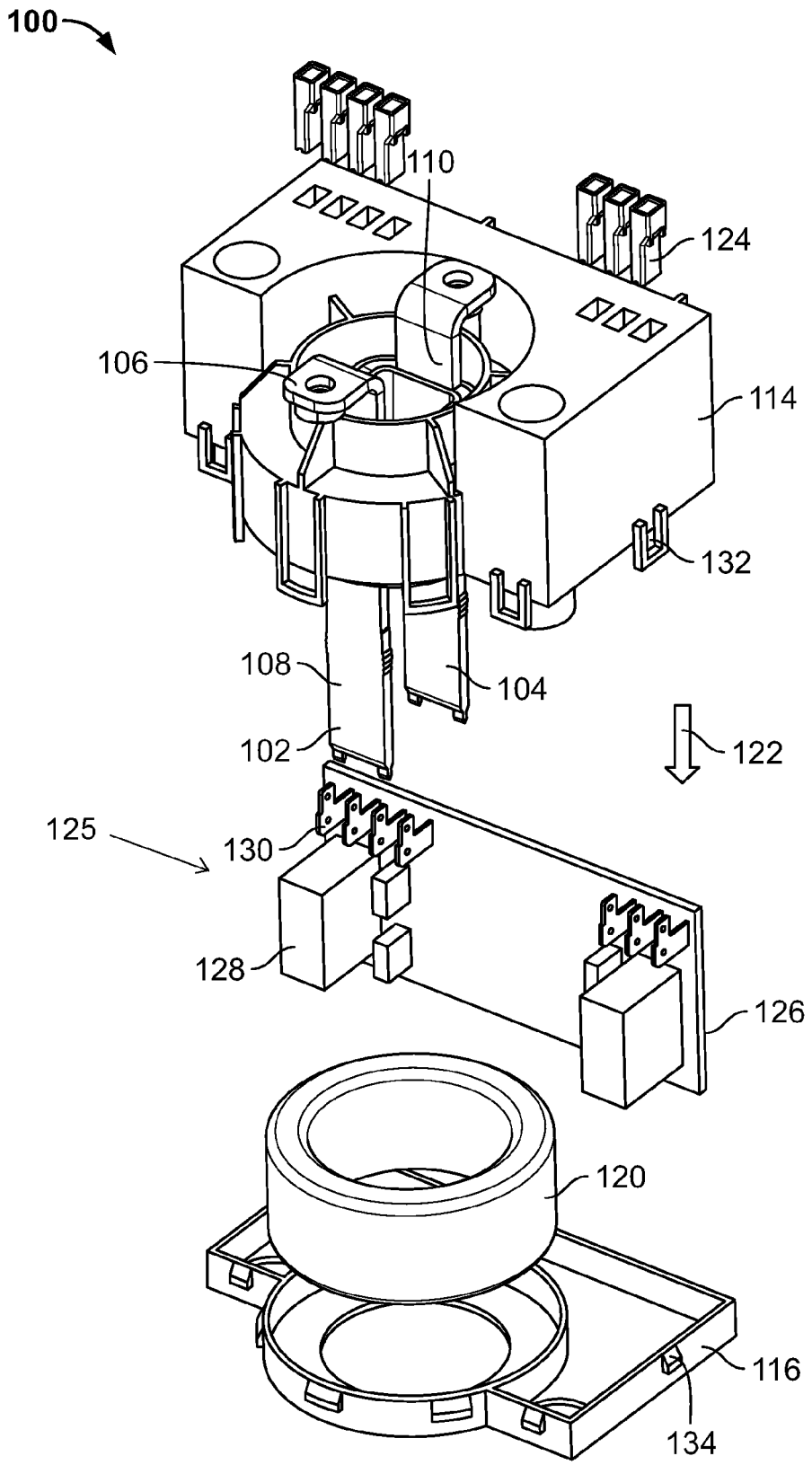
FIG. 2 is an exploded perspective view of the filter assembly of FIG. 1.

A filter assembly 100 according to the invention is shown generally in FIGS. 1 and 2. The filter assembly 100 has a first bus bar 102, a second bus bar 104, a filter housing 112, a ring core 120, and a filter circuit 125.

Each of the first and second bus bars 102, 104, as shown in FIGS. 1 and 2, has a first terminal section 106 and a second terminal section 108, wherein the first and second terminal sections 106, 108 are connected to one another via a connecting section 110. The second terminal sections 108 are designed as plug contacts. The second terminal sections 108 extend as a rectilinear prolongation in a straight line from the connecting section 110 and, as shown in FIG. 2, through the ring core 120. The first terminal sections 106 are terminal lugs having screw threads. The first terminal sections 106 are bent by 90° relative to the connecting section 110 in order to enable screwing along a longitudinal direction 122. The bus bars 102, 104 possess good current-carrying capacity and, due to the integrated configuration of plug contacts, have reduced losses.

The filter housing 112, as shown in FIGS. 1 and 2, has a base body 114 and a cover 116. The base body 114 and the cover 116 are fixed to one another via locking connections 118. As shown in FIG. 2, locking openings 132 of the base body 114 interact with corresponding locking tabs 134 at the cover 116. The base body 114 and cover 116 may alternatively be connected by ultrasonic welding, a glue connection or another suitable connection technique known to those with ordinary skill in the art.

The ring core 120 and the filter circuit 125 are accommodated in the filter housing 112, as shown in FIG. 2.

The filter circuit 125, as shown in FIG. 2, is arranged on a circuit carrier 126 disposed in the base body 114. The filter circuit 125 has a plurality of electronic components 128 and electrically conductive terminal lugs 130 disposed on the circuit carrier 126 and connected to filter terminals 124. The filter terminals 124 extend through the filter housing 112 and contact the filter circuit 125. The circuit carrier 126 is disposed in the filter housing 112 such that a plane defined by the circuit carrier 126 extends along the longitudinal direction 122, parallel to the bus bars 102, 104. The circuit carrier 126 may alternatively extend transversely or perpendicularly to the bus bars 102, 104.

The ring core 120 is formed from a magnetic material, and as shown in FIG. 2, may be formed by a torus-shaped ferrite ring. As would be understood by one with ordinary skill in the art, the ring core 120 may also be formed in other shapes symmetrical with regard to a longitudinal central axis.

The bus bars 102, 104 are held in the base body 114 via a press-fit and the ring core 120 is disposed in the filter housing 112. The first and second bus bars 102, 104 extend substantially parallel to each other and the connecting sections 110 of the bus bars 102, 104 extend through the ring core 120 along the longitudinal central axis, with at least a portion of the first and second bus bars 102, 104 disposed in the filter housing 112.

The circuit carrier 126 is disposed in a region of the filter housing 112 in which the connecting sections 110 are accommodated. The circuit carrier 126 is disposed above or underneath the ring core 120 and along the bus bars 102, 104. The circuit carrier 126 may alternatively be disposed within the opening of the ring core 120 and between the bus bars 102, 104. As would be understood by one with ordinary skill in the art, is also possible to provide several ring cores 120 in the filter housing 112.

Due to the design of the filter assembly 100 according to the invention as a closed module, any number of such filter assemblies 100 can be installed in a simple manner in a high-voltage connector 200 according to the present invention.

Figure 3:
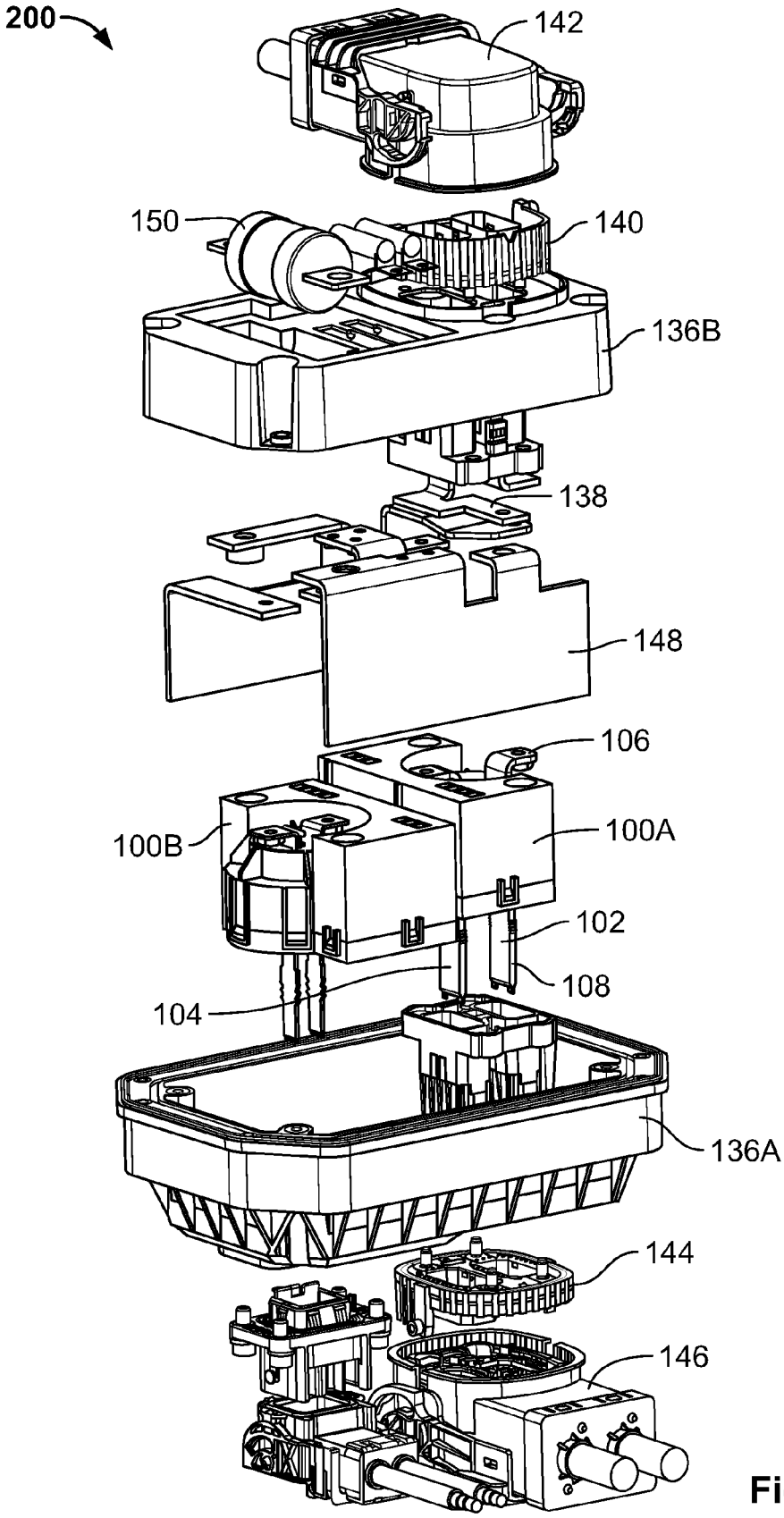
FIG. 3 is an exploded perspective view of a high-voltage connector having a plurality of filter assemblies according to the invention.
Figure 4:
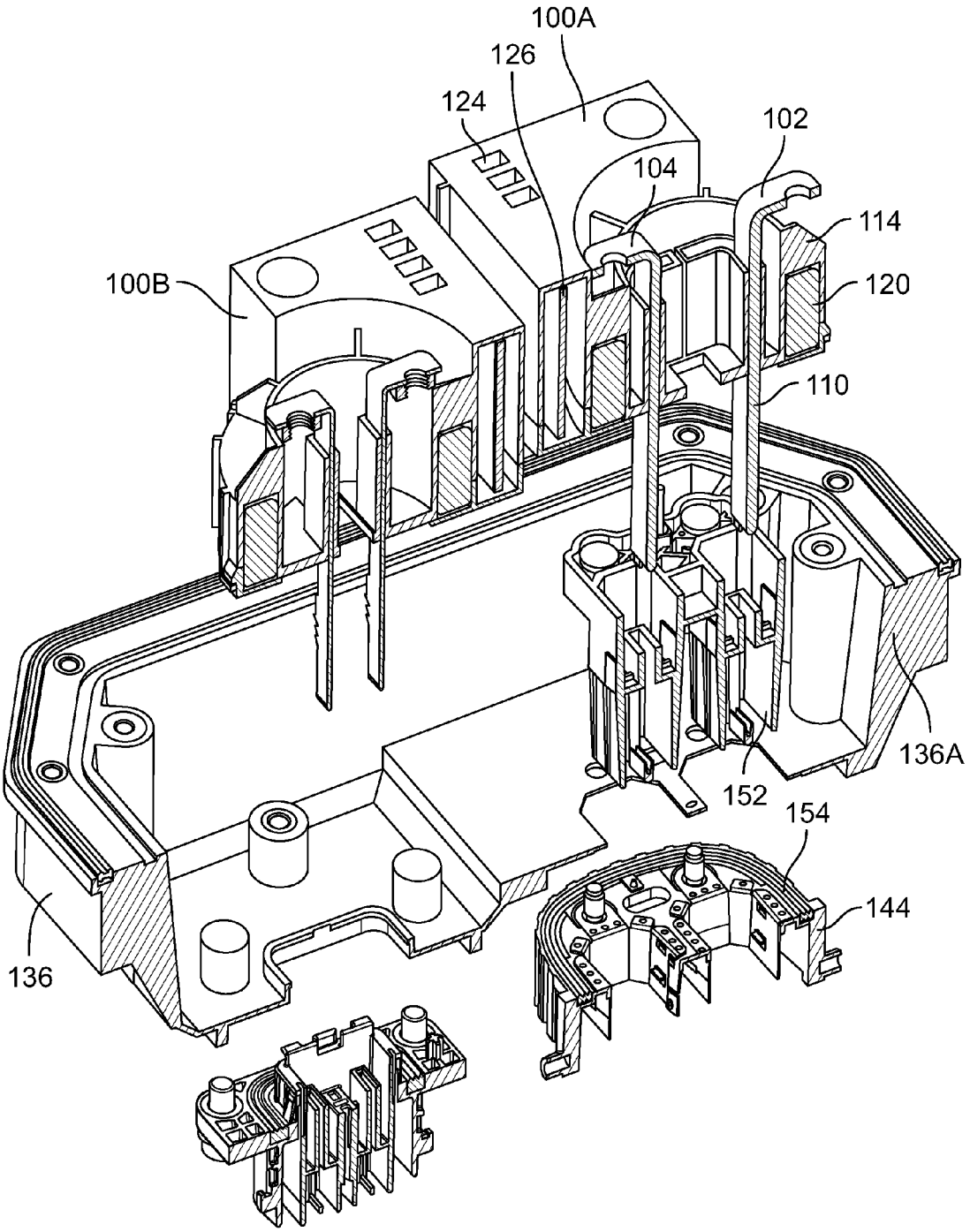
FIG. 4 is an exploded view of a portion of the high-voltage connector of FIG. 3.
Figure 5:
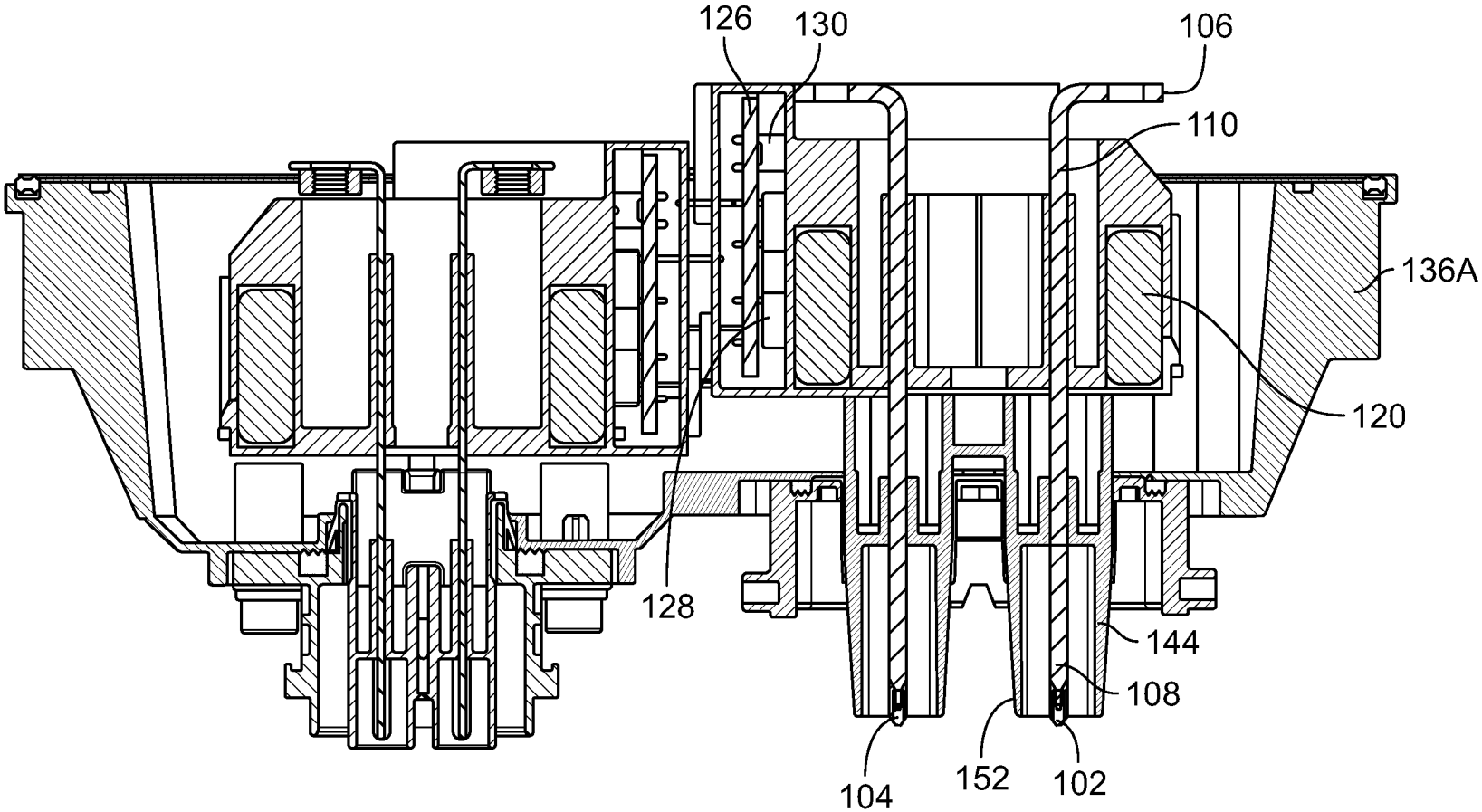
FIG. 5 is a sectional view of the portion of the high-voltage connector of FIG. 4.

The high-voltage connector 200 according to the present invention having a first filter assembly 100A and a second filter assembly 100B is shown in FIGS. 3-5. The filter assembly 100A corresponds to the embodiment shown in FIGS. 1 and 2, while the filter assembly 100B is constructed according to the same principles but has somewhat different dimensions. In the embodiment shown in FIGS. 3-5, the high-voltage connector 200 comprises a plurality of filter assemblies 100A, 100B each having a separate filter housing 112. Alternatively, the plurality of filter assemblies 100A, 100B may have an integrated common filter housing.

The high-voltage connector 200, as shown in FIG. 3, has a connector housing 136 formed by two half shells 136A, 136B which are screwed together. The filter assemblies 100A, 100B are disposed within the connector housing 136 and connect a first connector 140 to a second connector 144.

The first terminal sections 106 of the filter assemblies 100A, 100B are respectively coupled, via a screw and corresponding lead frames 138, to a first connector 140 which can be connected to a first mating plug connector 142 and a battery or other power source. Two second connectors 144, as shown in FIG. 3, are provided which can be connected to corresponding second mating plug connectors 146 and a power consumer. The second terminal sections 108 of the bus bars 102, 104 of each filter assembly 100A, 100B, as shown in FIGS. 3 and 5, directly form plug contacts of the second connectors 144 and directly electrically contact the second mating plug connectors 146.

The high-voltage connector 200 also has a shielding 148 disposed in the connector housing 136 and at least partly surrounding the two filter assemblies 100A, 100B to eliminate disturbance variables. External components 150 are attached externally to the housing half shell 136 B and are connected to the filter terminals 124 of the filter assemblies 100A, 100B.

As shown in FIG. 4, the bus bars 102, 104 of each filter assembly 100A, 100B extend through ring cores 120 held in the filter housings 112. The connecting sections 110 of the bus bars 102, 104 are held in the base body 114 by a press fit. The bus bars 102, 104 of each filter assembly 100A, 100B may be fixed in an inner insulator 152 of one of the second connectors 144. The circuit carriers 126, as shown in FIG. 4, are disposed parallel to the direction of extension of the connection sections 110 to save space. The second connectors 144, as shown in FIG. 4, have sealing elements 154 providing hermetic sealing of the interior of the connector housing 136 from the ingress of moisture or dust.

Advantageously, in the filter assembly 100 according to the invention, because the bus bars 102, 104 extend through the ring core 120, the filtering and inductive shielding of the bus bars 102, 104 can be performed in a particularly space-saving manner. The mechanical connections of the bus bars 102, 104 are stable and satisfy a motor vehicle's existing high requirements with regard to vibration resistance and temperature resistance. Furthermore, because the second terminal sections 108 of the bus bars 102, 104 directly form plug contacts of the second connectors 144 and directly electrically contact the second mating plug connectors 146, the integrated design of the high-voltage connector 200 reduces the number of electrical connections and electrically conductive components, requiring minimal installation space, while increasing filtering efficiency. Additionally, because additional plug contacts no longer have to be mounted for the second connector 144, the mounting outlay of the high-voltage connector 200 is reduced, the transfer resistance is kept low, and the reliability is increased.

What is claimed is:

1. A filter assembly for a high-voltage connector, comprising:

a first and a second bus bar, each bus bar having a first terminal section, a second terminal section formed as a plug contact, and a connecting section between the first terminal section and the second terminal section;

a filter circuit disposed on a circuit carrier;

a ring core;

a filter housing in which the filter circuit, the ring core, and at least a part of the first and second bus bars are disposed, the first and second bus bars extending substantially parallel to each other and through the ring core, the circuit carrier disposed in a region of the filter housing in which the connecting section of each of the first and second bus bars is accommodated; and a plurality of filter terminals extending through the filter housing separate from the first and second bus bars and electrically contacting the filter circuit.

2. The filter assembly of claim 1, wherein the first terminal section is connected to a first connector of the high-voltage connector.

3. The filter assembly of claim 2, wherein the second terminal section is connected to a second connector of the high-voltage connector.

4. The filter assembly of claim 3, wherein the ring core is formed from a magnetic material.

5. The filter assembly of claim 3, wherein the second terminal section of each of the first and second bus bars connects to a mating plug connector.

6. The filter assembly of claim 5, wherein the second terminal section of each of the first and second bus bars extends as a rectilinear prolongation from the connecting section of each of the first and second bus bars.

7. The filter assembly of claim 1, wherein the ring core is torus-shaped and a central axis of the ring core extends along the connecting section of each of the first and second bus bars.

8. The filter assembly of claim 1, wherein the filter housing has a base body in which the first and second bus bars and the circuit carrier are disposed and a cover fixed to the base body enclosing the filter housing.

9. The filter assembly of claim 8, wherein the base body and the cover are interlocked.

10. The filter assembly of claim 1, wherein the filter circuit is spaced apart and electrically isolated from the first and second bus bars inside the filter housing.

11. A high-voltage connector, comprising:

a first connector contacting a power source;

a second connector contacting a power consumer;

a connector housing; and a plurality of filter assemblies disposed in the connector housing and connecting the first and second connectors, each filter assembly having a first and a second bus bar, each bus bar having a first terminal section connected to the first connector, a second terminal section formed as a plug contact connected to the second connector, and a connecting section between the first terminal section and the second terminal section, a filter circuit disposed on a circuit carrier, a ring core, and a filter housing in which the filter circuit, the ring core, and at least a part of the first and second bus bars are disposed, the first and second bus bars extending substantially parallel to each other and through the ring core, the circuit carrier disposed in a region of the filter housing in which the connecting section of each of the first and second bus bars is accommodated, each filter assembly having a separate filter housing.

12. The high-voltage connector of claim 11, wherein the first terminal section of each of the first and second bus bars is connected by a screw to the first connector.

13. The high-voltage connector of claim 12, wherein the first connector is a plug connector.

14. The high-voltage connector of claim 11, wherein the connecting section of each of the first and second bus bars of each of the plurality of filter assemblies extend parallel to one another.

15. The high-voltage connector of claim 14, further comprising a shielding disposed in the connector housing and at least partly surrounding the plurality of filter assemblies.

16. The high-voltage connector of claim 11, wherein at least one of the first and second connectors hermetically seals the filter assembly.

17. The high-voltage connector of claim 11, wherein each filter assembly has a plurality of filter terminals extending through the filter housing separate from the first and second bus bars and electrically contacting the filter circuit.

18. The high-voltage connector of claim 17, further comprising a plurality of external components attached to the connector housing.

19. The high-voltage connector of claim 18, wherein the plurality of external components are electrically connected to the plurality of filter terminals.

* * * * *